US006010262A

United States Patent [19]

Linyear et al.

[11] Patent Number: 6,010,262

[45] Date of Patent: Jan. 4, 2000

[54] KEYBOARD SHIELD AND COPY HOLDER

[76] Inventors: Jessie B. Linyear; Richard A. Linyear, both of 700 Harbor Quay, Chesapeake, Va. 23320

[21] Appl. No.: 09/316,607

[22] Filed: May 21, 1999

[51] Int. Cl.[7] ..... B41J 11/62

[52] U.S. Cl. ..... 400/714; 248/441.1; 312/208.3

[58] Field of Search ..... 400/713, 714, 400/691, 694, 472, 719; 434/227; 312/208.1, 208.3; 248/457, 442.2, 441.1, 454

[56] References Cited

U.S. PATENT DOCUMENTS

| | | | |
|---|---|---|---|
| D. 342,944 | 1/1994 | Rhodes . | |
| 735,252 | 8/1903 | Harrod | 248/454 |
| 844,025 | 2/1907 | Keesling et al. | 400/714 |
| 889,184 | 5/1908 | Gilbert | 400/714 |
| 999,539 | 8/1911 | Anderson | 400/718 |
| 1,389,419 | 8/1921 | Briggs . | |
| 1,447,563 | 3/1923 | Moon | 400/714 |
| 3,762,528 | 10/1973 | Garman . | |
| 3,971,140 | 7/1976 | Martinez . | |
| 4,294,557 | 10/1981 | Blanchard et al. . | |
| 4,449,763 | 5/1984 | Barnett . | |
| 5,383,643 | 1/1995 | Koch . | |
| 5,419,704 | 5/1995 | North . | |

*Primary Examiner*—Ren Yan
*Assistant Examiner*—Amanda B. Sandusky
*Attorney, Agent, or Firm*—Joy L. Bryant

[57] ABSTRACT

A keyboard shield and copy holder is presented. The keyboard shield and copy holder has a top plate member having downward extending left and right side panels and a bottom plate member having upward extending left and right side panels. Each upward extending left and right side panel of the bottom plate member is adjustably engaged with each respective downward extending left and right side panel of the top plate member.

15 Claims, 5 Drawing Sheets

KEYBOARD SHIELD AND COPY HOLDER

FIELD OF THE INVENTION

The present invention relates to a keyboard shield and copy holder. In particular, it relates to a keyboard shield and copy holder having adjustable positions.

BACKGROUND OF THE INVENTION

One difficulty encountered in the training of typists and keyboard operators is training the user not to look at the keys while the keys are being stroked. Rather, it is the objective to teach the operator to look at the copy material that is to be keyed. This technique is known as "touch typing". Several aids to block one's view of the keyboard have been devised in the past. However, these devices are either designed to cover a typewriter and would not work with a computer keyboard or they are not robust enough to support the weight of books or thicker documents. Other designs permit the shield to be moved from one position to another while in use, thus allowing the user to be able to view the keys. Lastly, keyboard covers have been proposed but they are primarily designed to protect the keyboard while it is not in use.

U.S. Pat. No. 1,389,419 to Briggs discloses a shield and divider that is attached to the keyboard of a typewriter. In particular, the shield has a downwardly extending and laterally deflected partition wall, the bottom edge of which is so formed that it may be positioned in the interval between the central rows of keys in the keyboard and divides the keys into two zones. Such a device would not work with modern-day keyboards because the keys are positioned such that there is no precise way to divide them.

U.S. Pat. No. 3,762,528 to Garman is for a pivotable shield which incorporates a movable screen member having two sections, interconnected by hinge means, with one of these movable sections pivotably mounted to a holding member. The holding bar is secured to a support member that is attached to the typewriter itself, and extended over from the back, or in front of the typewriter in such a manner to allow the shield assembly to be secured thereto. This device is inadequate for holding large documents or books.

U.S. Pat. No. 3,971,140 to Martinez describes a keyboard interceptor which is an upright standard having front and rear sides and mounting means on its lower end for releasable mounting from a support upon which a typewriter may be placed. More specifically, the device must be mounted to the forward marginal edge of a table. This mount is cumbersome and has a tendency to not always be fully secured by the user.

U.S. Pat. No. 4,294,557 to Blanchard et al. discloses a cardboard shield for a typewriter keyboard and cylinder. The shield is folded to pass under the feet of the typewriter in order to hold the device in place. The keyboard shield portion is flexibly attached to the top of the typewriter so that the operator can raise the keyboard portion simply by raising his wrists against the bottom of it. This enables him to check the position of his hands on the keyboard. Such a device requires that the shield be secured to the top of the typewriter by means of a snap clip assembly. The clip engages the typewriter casing at the edge of the well found on many typewriters near the cylinder. Many modem-day typewriters no longer have the well nor do computer keyboards have a well. In turn, there is no place to attach the snap clip assembly. Moreover, the cardboard material is not strong enough to support the weight of a heavy copy or book.

U.S. Pat. No. 4,449,763 to Barnett discloses a protective cover for keyboard machines. A transparent hood is affixable to the machine housing and open at one side to admit the operator's hand. A panel is provided that is generally parallel to the keyboard face and spaced apart therefrom by a distance sufficient to allow normal hand and finger movements by the operator, but too close to permit any appreciable whole-hand movements. Such a device would not be suitable for one who is using a keyboard because whole-hand movement is required.

U.S. Des. Pat. No. 342,944 to Rhodes is for a collapsible keyboard vision shield. Although the device is portable, it is incapable of holding any copy and can be easily moved with the wrist of the user during use.

U.S. Pat. No. 5,383,643 to Koch describes a keyboard cover and copy holder that has a first plate member and a second plate member pivotally connected to the first member. Each plate member has a rectangular main plate segment and a flange segment which extends perpendicularly to the segment and around three sides of the plate segment. The second plate member may be positioned in a first position in which it and the first plate member have a flat configuration, thus serving as a keyboard cover. Alternatively, the second plate member may be positioned in a second position in which it and the first plate member lie at an acute angle. In this instance, the device serves as a copy holder. This device cannot serve as a keyboard shield and copy holder at the same time.

U.S. Pat. No. 5,419,704 to North describes a keyboard training aid that has a support resting on the keyboard around the text entry keys and an opaque cover pivotally mounted on the support. Two apertures are in the top cover and aligned between the keyboard operator and the home keys in the center row so that the home keys can be viewed. There is no disclosure that the device can support copy materials.

An object of the present invention is to provide a keyboard shield and copy holder that is adjustable between several positions.

Another object of the present invention is to provide a keyboard shield and copy holder that can support copy of various sizes and weights.

Another object of the present invention is to provide a keyboard shield and copy holder that does not permit movement of the shield by the operator's wrists.

Another object of the present invention is to provide a keyboard shield and copy holder that is suitable for modem-day typewriters and computer keyboards.

SUMMARY OF THE INVENTION

The foregoing objects are achieved by the present invention. The keyboard shield and copy holder comprises a top plate member having downward extending left and right side panels; and a bottom plate member having upward extending left and right side panels. Each upward extending left and right side panel of the bottom plate member is adjustably engaged with each respective downward extending left and right side panel of the top plate member. This design allows for the keyboard shield to be adjusted through several positions. A first position fully obstructs the view of the keyboard. In the second position, the keyboard is partially visible and in the third position, the keyboard is fully exposed. Copy may be viewed in any of the positions. The variety of positions allows for several advantages. When the view of the keyboard is fully obstructed, it forces the user to learn the "touch type" keyboarding technique. Adjusting to a partial or full view of the keyboard permits the user to see the keys when necessary to confirm proper positioning. The copy holder saves space because the copy is stored directly above the keyboard rather than off to one side. This is advantageous when desk space is limited. Adjustment of the keyboard shield and copy holder not only permits the user to view the keyboard but also adjust the position of the copy. Thus, the user can view the copy and the resulting work product at the same time.

Additional objects and advantages of the invention will be set forth in part in the description which follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which.

DETAILED DESCRIPTION OF THE PREFERRED EMBODIMENTS

Figure 1:
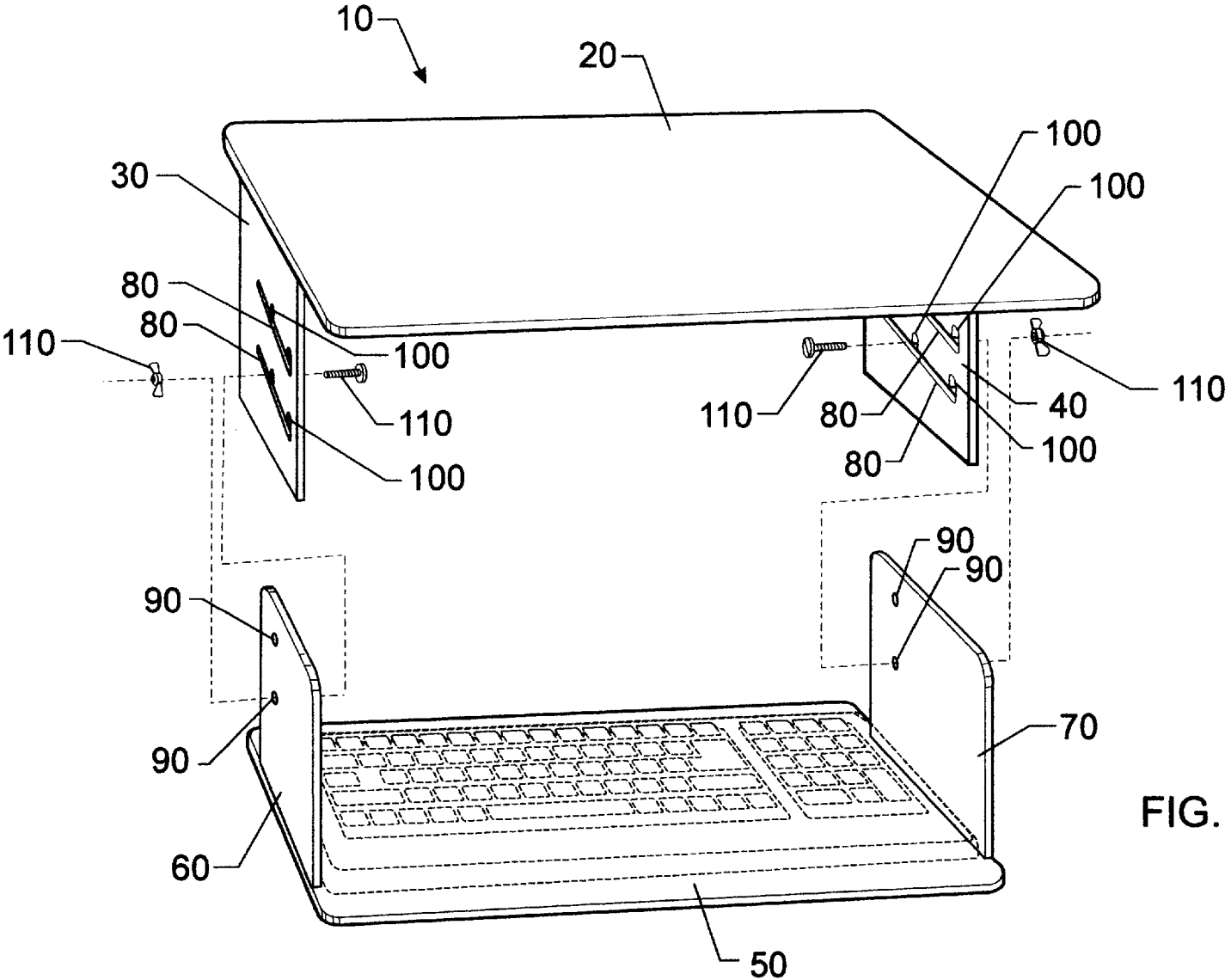
FIG. 1 is a perspective view of an embodiment of the invention when it is disassembled. The operable relationship of the fastener with respect to the downward extending and upward extending left and right side panels is also shown.

Referring now to the figures where similar parts are numbered the same throughout. FIG. 1 is a perspective view of an embodiment of the invention when it is disassembled. The keyboard is shown in phantom. In this embodiment, the keyboard shield and copy holder 10 comprises a top plate member 20 having downward extending left 30 and right 40 side panels and a bottom plate member 50 having upward extending left 60 and right 70 side panels. Each upward extending left 60 and right 70 side panel of the bottom plate member 50 is adjustably engaged with each respective downward extending left 30 and right 40 side panel of the top plate member 20 such that the downward extending left 30 and right 40 side panels are interior to the upward extending left 60 and right 70 side panels. The side panels are secured with a fastener 110. Any fastener known to those skilled in the art may be used and FIG. 1 depicts a preferred embodiment wherein the fastener is a wing nut. The top plate member 20 and the bottom plate member 50 are comprised of any rigid material known to those skilled in the art, provided it is not cardboard. Preferably the material is a polymeric material.

Any means known to those skilled in the art may be used to adjustably engage the side panels. FIG. 1 shows one embodiment wherein each downward extending left 30 and right 40 side panel has at least one, preferably two, angled slots 80 disposed therein. The slots 80 are configured to angle downward to form an acute angle with respect to the bottom plate member 50. Each upward extending left 60 and right 70 side panel has at least one, preferably two, bores 90 disposed therein and a fastener 110 is positioned in an operable relationship to the slot 80 and the bore 90. The operable relationship is defined such that the fastener 110 passes through the slot 80 and the bore 90 to secure the top plate member 20 to the bottom plate member 50. Alternatively, the configuration could be reversed wherein each downward extending left and right side panel has at least one, preferably two, bores disposed therein, and each upward extending left and right side panel has at least one, preferably two, angled slots disposed therein. In another embodiment, each downward extending left and right side panel has at least one, preferably two, angled slots disposed therein and each upward extending left and right side panel has at least one, preferably two, angled slots disposed therein. Another embodiment is such that each downward extending left and right side panel has at least one, preferably two, bores disposed therein, and each upward extending left and right side panel has at least one, preferably two, bores disposed therein. In another embodiment, each angled slot 80 is modified such that it further comprises at least one stop 100. The stop 100 prohibits further movement or sliding motion of the fastener 110.

Figure 2:
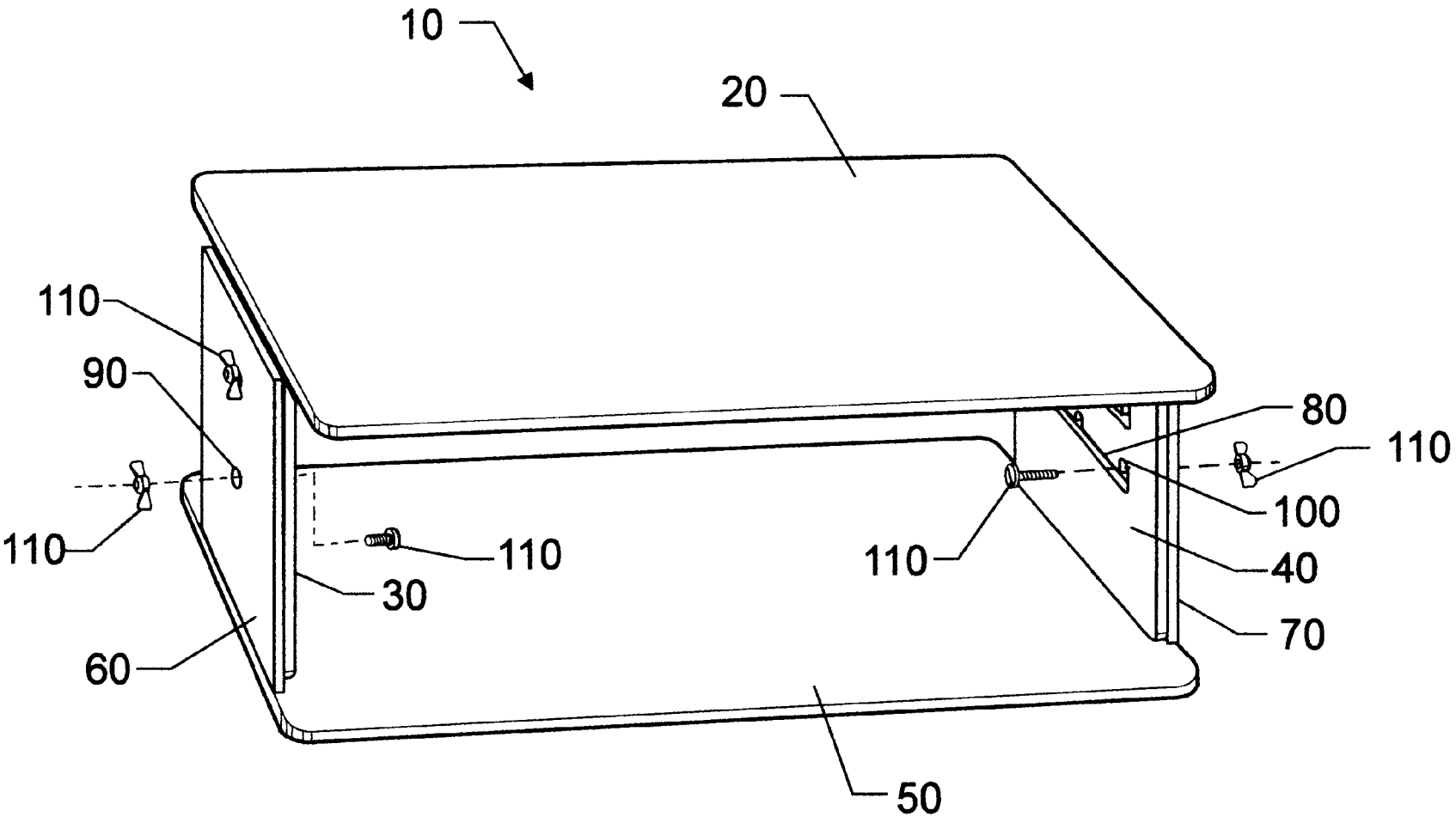
FIG. 2 is a perspective view of one embodiment of the invention when it is in assembled form.

FIG. 2 depicts the keyboard shield and copy holder 10 in its assembled form. When assembling the keyboard shield and copy holder 10, each angled slot 80 in each downward extending left 30 and right 40 side panel is aligned with each bore 90 in each upward extending left 60 and right 70 side panel. A fastener 110 is positioned in an operable relationship to each slot 80 and each bore 90. The operable relationship is defined such that the fastener 110 passes through the slot 80 and the bore 90 and secures the top plate member 20 and the bottom plate member 50 in place. If the angled slot 80 has a stop 100, the fastener 110 passes through the slot 80 at the stop 100 and then through the bore 90. Any fastener known to those skilled in the art may be used. Examples of various fasteners include but are not limited to: a screw; a wing nut; a snap lock; a bolt; a tongue protruding from each upward extending side panel which is seated in an angled slot or groove; a rivet; a hook; a post; a clip; a plug; an anchor; a peg; a binder; a catch; a clamp; a clasp; a dowel; a pin; and a cleat. Preferably, the fastener is a wing nut.

Figure 3:
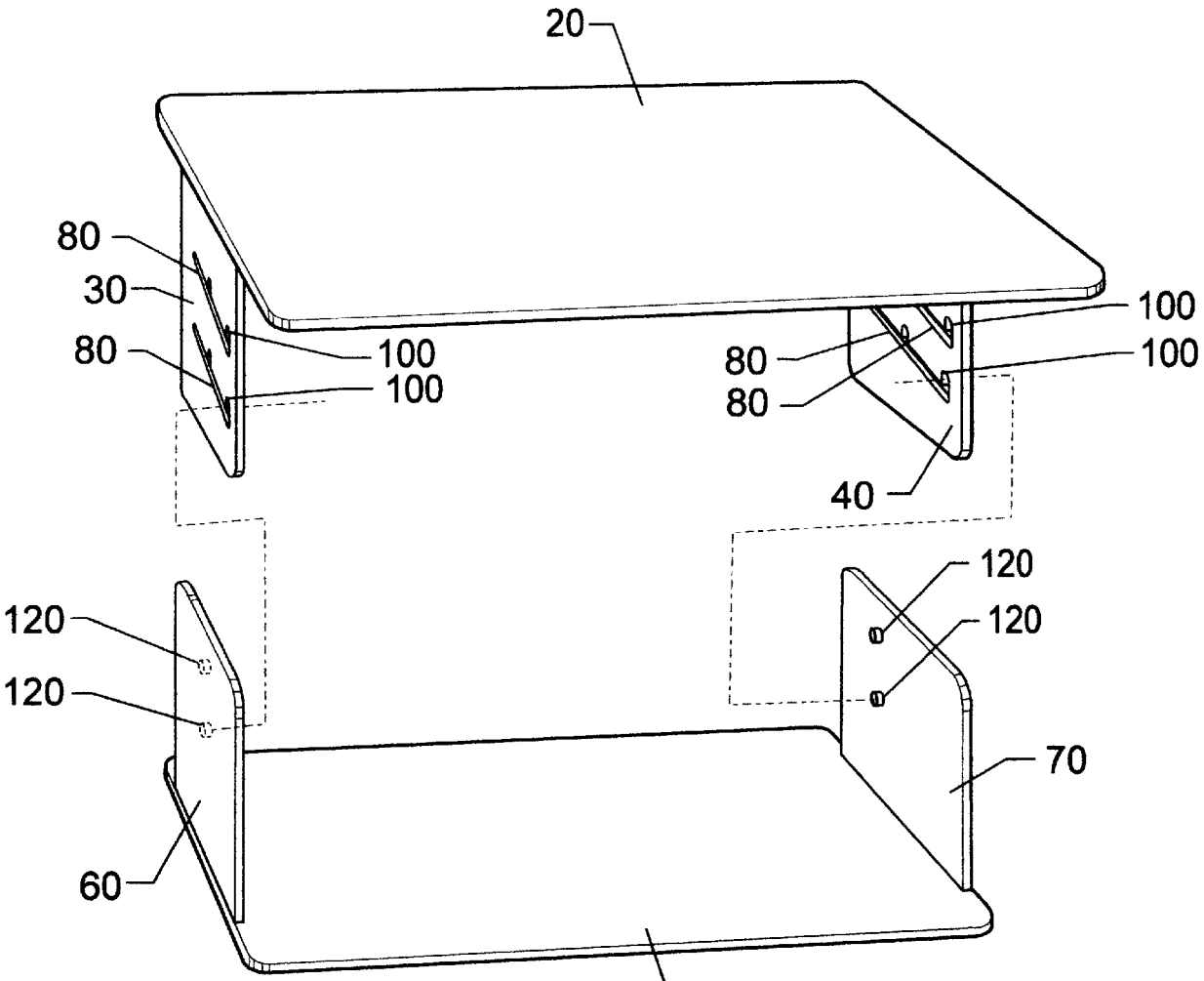
FIG. 3 is an alternative embodiment to the invention wherein the fastener is a tongue that protrudes from each upward extending side panel and cooperates with each angled slot in each downward extending side panel.

FIG. 3 shows another embodiment of the invention wherein the fastener is a tongue 120 that protrudes from each upward extending left 60 and right 70 side panel. Each tongue 120 slides into each respective angled slot 80 in each downward extending left 30 and right 40 side panel and locks at the stop 100 in each slot 80 to hold the top plate member 20 in position with respect to the bottom plate member 50.

Figure 4:
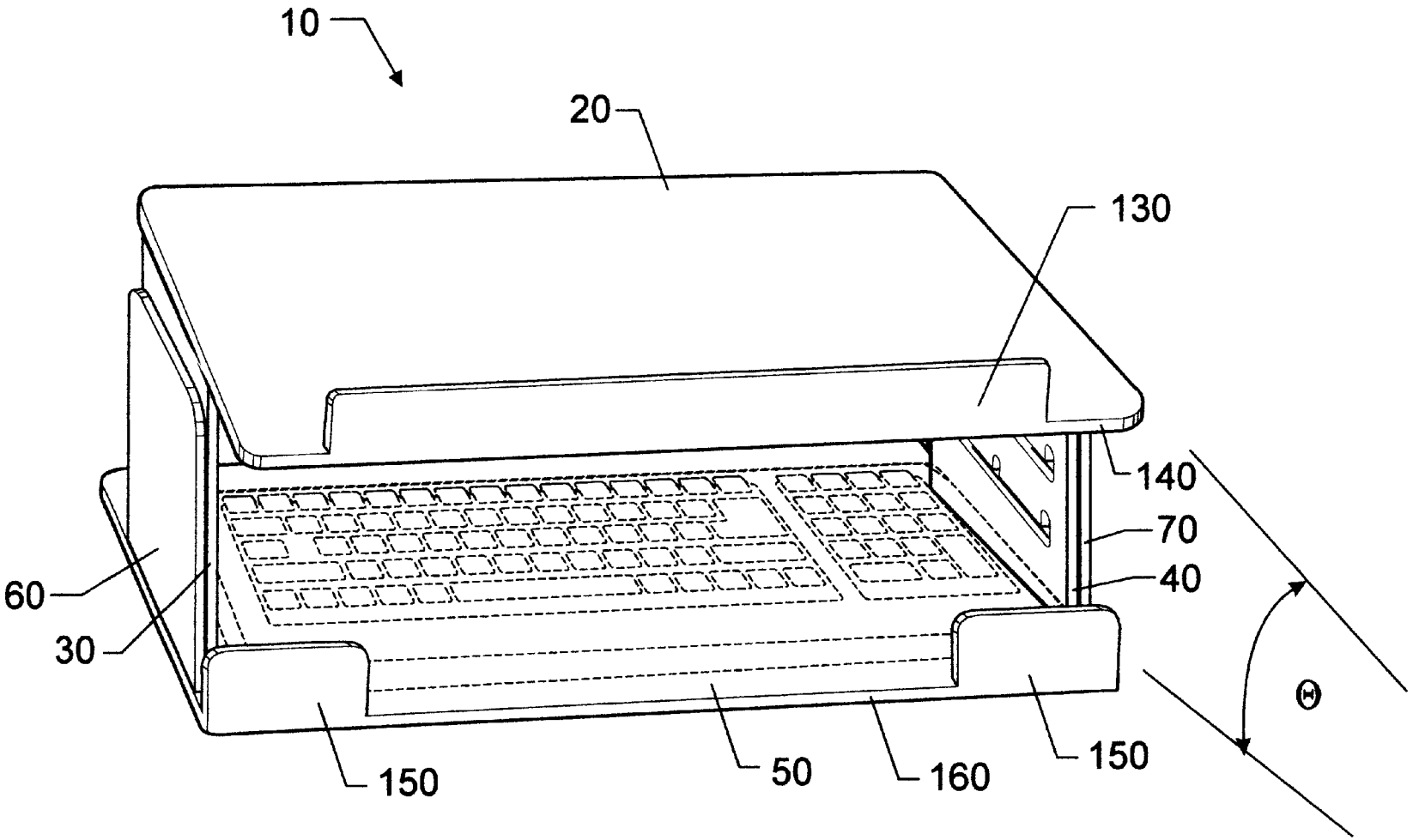
FIG. 4 depicts a preferred embodiment of the invention in assembled form where the top plate member and the bottom plate member each have at least one flange and the top plate member forms an acute angle with respect to the bottom plate member.

FIG. 4 shows a preferred embodiment of the invention in assembled form wherein the top plate member 20 has at least one flange 130 extending upward from a front portion 140 of the top plate member 20. The size and placement of the flange(s) can vary depending on the need of the user. For example, a single flange may be centered near the edge 140 of the top plate member 20, as shown. This flange may be as small as one-inch in length or may run the entire length of the top plate member. In addition, the flange does not have to be at the edge 140 of the top plate member 20 but may be spaced away from the edge 140. Smaller multiple flanges may be spaced along or near the edge of the top plate member. The flanges function to support the copy and to keep it from sliding off of the top plate member 20. When no flange is present, another means of securing the copy in place must be used. However, if the keyboard shield and copy holder 10 is only to be used to shield the keyboard, then nothing is needed to hold copy.

In addition to the top plate member 20 having a flange 130, the bottom plate member 50 is shown in FIG. 4 as having a pair of flanges 150 extending upward from a front portion 160 of the bottom plate member 50. Preferably, each flange 150 is positioned at each corner edge at the front portion 160 of the bottom plate member 50. Although a pair of flanges are shown, only one flange may be used. If a single flange is used, it should be centered near the front edge of the bottom plate member 50. The pair of flange(s) are not necessary, however, they do prevent the keyboard from sliding or moving forward off of the bottom plate member 50. In use, the keyboard (shown in phantom) is placed on top of the bottom plate member 50 such that it comes forward and rests against the flanges 150.

FIG. 4 shows one preferred configuration of the top plate member 20 with respect to the bottom plate member 50 such that the top plate member 20 forms an acute angle θ in relationship to the bottom plate member 50. This angle facilitates the ease of reading copy which is placed on the keyboard shield and copy holder 10. Alternatively, the top plate member 20 may remain parallel or at a zero degree angle with respect to the bottom plate member 50. Regardless of the configuration, there is enough room between the top plate member 20 and the bottom plate member 50 to allow the user's hands to move freely about the whole keyboard without disturbing the keyboard shield and copy holder. The side panels 30, 40, 60 and 70 prevent the keyboard from shifting to the left or right.

Figures 5A, 5B, 5C:
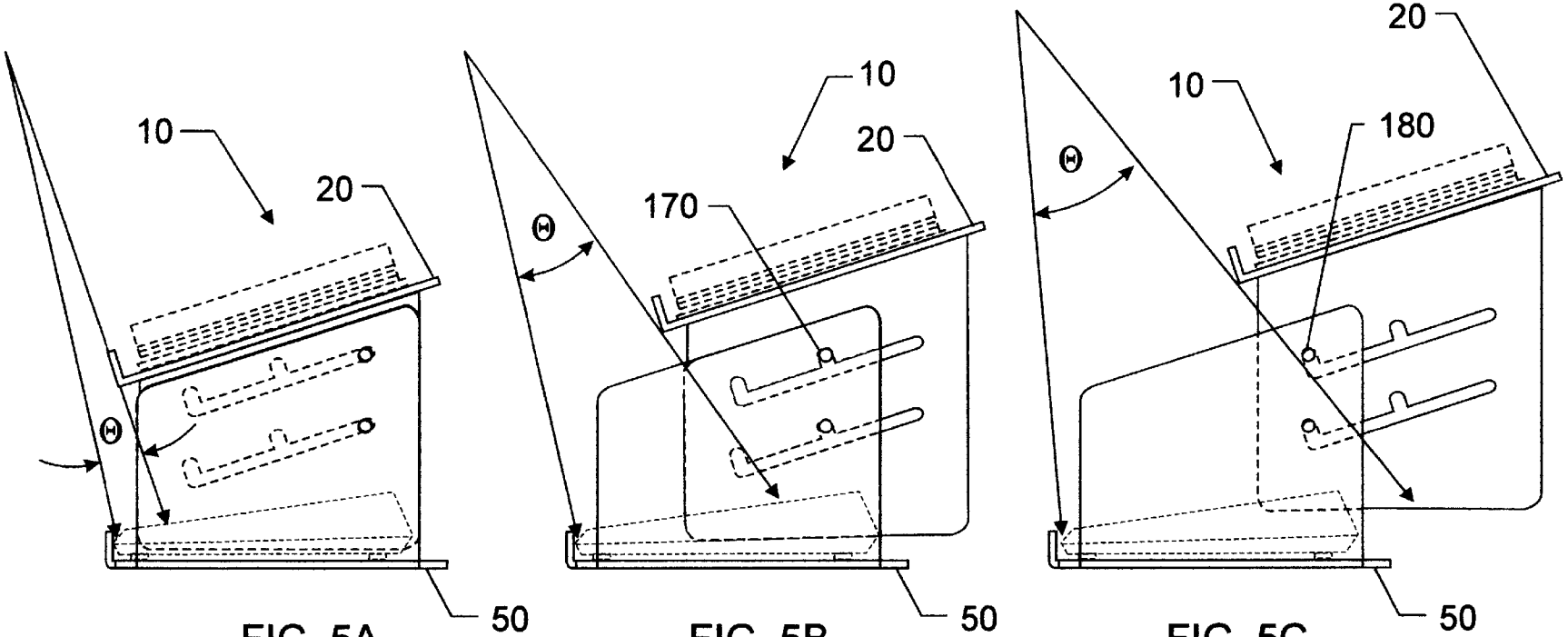
FIGS. 5A–C are side views indicating the visual angle of reference for the operator and three preferred positions for the keyboard shield and copy holder.

FIGS. 5A–C show side views indicating the visual angle of reference for the operator and three preferred positions for the keyboard shield and copy holder 10. The keyboard shield and copy holder 10 is designed such that each upward extending left and right side panel is adjustably engaged with each downward extending left and right side panel. When the preferred slot with stop and bore configuration is used, the keyboard shield and copy holder may be adjusted to three operational positions.

FIG. 5A depicts a first position, wherein the keyboard is concealed but the copy may be viewed. In this position, the downward extending left and right side panels rest on the bottom plate member 50 and the angle θ formed between the top plate member 20 and the bottom plate member 50 is small. This is possible because the portion of the downward extending left and right side panels that is connected to the underside of the top plate member 20 is angled to allow for the top plate member 20 to form an acute angle with the bottom plate member 50.

FIG. 5B shows the partial view position where the top plate member 20 has been moved and is positioned in a first stop position 170 on the angled slots. In this position, the keyboard is partially visible. The angle θ formed between the top plate member 20 and the bottom plate member 50 is greater than that of the first position, or that shown in FIG. 5A. The copy is easily viewed.

FIG. 5C shows the fully visible position, where the top plate member 20 is positioned in a second stop position 180 such that the keyboard is in full view and the copy may be viewed. The angle θ formed between the top plate member 20 and the bottom plate member 50 is larger than the angle for the second position, or that shown in FIG. 5B.

EXAMPLES

Example 1

A keyboard shield and copy holder was constructed from an acrylic plastic in the following manner. A bottom plate member of approximately 20 inches by 9 inches was provided. The corners were rounded to avoid snagging and personal injury. Upward extending left and right side panels were attached at the edges of the left and right sides of the bottom plate member. The left and right side panels were approximately 5 inches wide and were angled to range in height from approximately 5¾ inches towards the rear of the device to about 4¼ inches in the front of the device. The corners of the side panels were rounded to avoid snagging. A bore of about ¼ inch in diameter was positioned at approximately 1⅜ inch from the top edge of each side panel and ⅞ inch from the back edge of each side panel. A second bore of about ¼ inch in diameter was positioned approximately 2⅞ inch from the top edge and ⅞ inch from the back edge of each side panel. An upward extending flange approximately 2 inches wide by 1 inch high was attached at each corner edge where the bottom plate member and the upward extending left and right side panels come together.

A top plate member of approximately 20 inches by 10 inches was provided. The corners were rounded to avoid snagging or injury. A flange of approximately 15 inches by 1 inch was centered and attached to the top front edge of the top plate member. Downward extending left and right side panels ranging from 7 inches to 5 inches in height and 5 inches wide were attached to the underside of the top plate member at each respective side edge. The corners were rounded to avoid snagging or injury. Two angled parallel slots, each approximately 3¼ inch long and ¼ inch wide, beginning and ending approximately ¾ inch from each edge were formed on each downward extending left and right side panel. The top slot was about 2¼ inch from the top edge of the side panel where the bottom slot was approximately 3⅞ inch from the top edge of the side panel. Each slot had two stops.

The bottom plate member was positioned on a desk. The keyboard was placed on top of the bottom plate member such that the upward extending left and right side panels extended upward along the sides of the keyboard. The top plate member was positioned above the keyboard such that the downward extending side panels were alongside the upward extending side panels. The downward extending side panels were nearest the keyboard and rested on the bottom plate member. The slots in the downward extending left and right side panels were aligned with the bores of the upward extending left and right side panels. A nylon wing nut was inserted through each bore and slot to secure the top plate member to the bottom plate member. In this position, the keyboard was concealed from the user. The flange extending upward from the top plate member was used to hold copy material. The height of the device ranged from approximately 5 inches to 8 inches and the span or depth was approximately 9½ inches.

Example 2

The keyboard shield and copy holder of Example 1 was positioned such that a portion of the keyboard could be viewed. The wing nuts were loosened. The top plate member was raised and slid along the slots until the middle stop was reached. The wing nuts were secured. The letter keys were visible and the copy was placed on the top plate member to rest against the upward extending flange. The height of the device ranged from approximately 5½ inches to 8½ inches. The span or depth was approximately 10½ inches.

Example 3

The keyboard shield and copy holder of Example 1 was adjusted to a third position which allowed the entire keyboard to be visible and the copy seen. The wing nuts were loosened and the top plate member lifted and slid along the slots to the top stop position. The wing nuts were tightened to secure the top plate member to the bottom plate member. The height range in this position was approximately 6 inches to 8¾ inches. The span or depth was approximately 12½ inches.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed is:

1. A keyboard shield and copy holder comprising:

a top plate member having downward extending left and right side panels; and a bottom plate member having upward extending left and right side panels wherein each upward extending left and right side panel of the bottom plate member is adjustably engaged with each respective downward extending left and right side panel of the top plate member.

2. A keyboard shield and copy holder according to claim 1, further comprising at least one flange extending upward from a front portion of the top plate member.

3. A keyboard shield and copy holder according to claim 1, further comprising at least one flange extending upward from a front portion of the bottom plate member.

4. A keyboard shield and copy holder according to claim 1, wherein each downward extending left and right side panel has at least one angled slot disposed therein and wherein each upward extending left and right side panel has at least one bore disposed therein.

5. A keyboard shield and copy holder according to claim 4, wherein each downward extending left and right side panel is adjustably engaged with each upward extending left and right side panel with at least one fastener positioned in an operable relationship to each angled slot and each bore.

6. A keyboard shield and copy holder according to claim 4, wherein each angled slot further comprises at least one stop.

7. A keyboard shield and copy holder according to claim 6, wherein each downward extending left and right side panel is adjustably engaged with each upward extending left and right side panel with at least one fastener positioned in an operable relationship to each bore and to the stop of each angled slot.

8. A keyboard shield and copy holder according to claim 1, wherein each downward extending left and right side panel has at least one bore disposed therein and wherein each upward extending left and right side panel has at least one angled slot disposed therein and wherein each downward extending left and right side panel is adjustably engaged with each upward extending left and right side panel with at least one fastener positioned in an operable relationship to at least one bore and at least one angled slot.

9. A keyboard shield and copy holder according to claim 8, wherein each angled slot further comprises at least one stop and wherein at least one fastener is positioned in an operable relationship to each bore and to the stop of each angled slot.

10. A keyboard shield and copy holder according to claim 1, wherein each upward extending left and right side panel of the bottom plate member is adjustably engaged with each respective downward extending left and right side panel of the top plate member with a fastener.

11. A keyboard shield and copy holder according to claim 10, wherein the fastener is selected from the group consisting of: a screw; a wing nut; a snap lock; a bolt; a tongue and groove; a rivet; a hook; a post; a clip; a plug; an anchor; a peg; a binder; a catch; a clamp; a clasp; a dowel; a pin; and a cleat.

12. A keyboard shield and copy holder according to claim 11, wherein the fastener is a wing nut.

13. A keyboard shield and copy holder according to claim 1, wherein the top plate member is positioned at an acute angle with respect to the bottom plate member.

14. A keyboard shield and copy holder according to claim 1, wherein the top plate member and the bottom plate member are comprised of a polymeric material.

15. A keyboard shield and copy holder comprising:

a polymeric top plate member having downward extending left and right side panels; at least one flange extending upward from a front portion of the top plate member; at least one angled slot disposed within each downward extending left and right side panel;

a polymeric bottom plate member having upward extending left and right side panels; at least one flange extending upward from a front portion of the bottom plate member; at least one bore disposed within each upward extending left and right side panel; and at least one fastener positioned in an operable relationship to each angled slot and each bore for engaging the top plate member at an acute angle to the bottom plate member.

* * * * *